US005531488A

United States Patent [19]

Yoshikuwa et al.

[11] Patent Number: 5,531,488

[45] Date of Patent: Jul. 2, 1996

[54] VEHICLE DOOR LOCK DEVICE

[75] Inventors: Masakatsu Yoshikuwa, Kofu; Tsuguo Hoshikawa, Nirasaki, both of Japan

[73] Assignee: Mitsui Kinzoku Kogyo Kabushiki Kaisha, Tokyo, Japan

[21] Appl. No.: 442,961

[22] Filed: May 17, 1995

[30] Foreign Application Priority Data

| | | | |
|---|---|---|---|
| May 20, 1994 | [JP] | Japan | 6-131023 |
| May 25, 1994 | [JP] | Japan | 6-135084 |
| May 31, 1994 | [JP] | Japan | 6-140940 |

[51] Int. Cl.[6] ..... E05C 3/16

[52] U.S. Cl. ..... 292/216; 292/DIG. 23; 292/DIG. 26

[58] Field of Search ..... 292/216, DIG. 23, 292/DIG. 26

[56] References Cited

U.S. PATENT DOCUMENTS

| | | | |
|---|---|---|---|
| 3,334,935 | 8/1967 | Eddy | 292/216 |
| 3,563,589 | 2/1971 | Kwasiborski, Jr. | 292/216 |
| 3,572,791 | 3/1971 | Foley | 292/216 |
| 3,591,220 | 6/1971 | Sandor | 292/216 |
| 3,695,662 | 10/1972 | Ploughman | 292/280 |
| 3,697,105 | 10/1972 | Marx | 292/216 |
| 4,364,590 | 12/1982 | Hamada | 292/336.3 |
| 4,538,845 | 9/1985 | Yamada | 292/216 |
| 5,015,020 | 5/1991 | Mizuki | 292/216 |
| 5,106,135 | 4/1992 | Menke et al. | 292/216 |

*Primary Examiner*—Steven N. Meyers
*Assistant Examiner*—Donald J. Lecher
*Attorney, Agent, or Firm*—Browdy and Neimark

[57] ABSTRACT

A vehicle door lock device comprises a first group lever consisting of three kinds of ratchet levers connected to a ratchet, and a second group lever consisting of two kinds of opening levers connected to an outer opening handle. First variation of the lock device having one-motion opening and self-canceling mechanisms can be realized by the first combination of a first ratchet lever and a first opening lever. Second variation of the lock device having one-motion opening mechanism but self-canceling mechanism can be realized by the second combination of a third ratchet lever and the first opening lever. Third variation of the lock device having self-canceling mechanism but one-motion opening mechanism can be realized by the third combination of a second ratchet lever and a second opening lever.

1 Claim, 8 Drawing Sheets

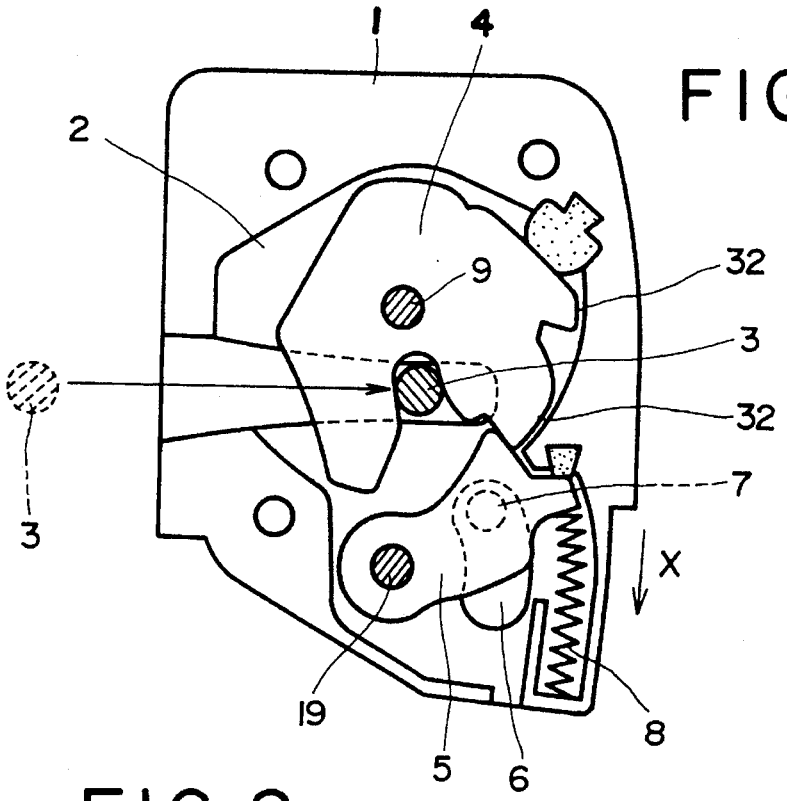
FIG. 1
FIG. 2
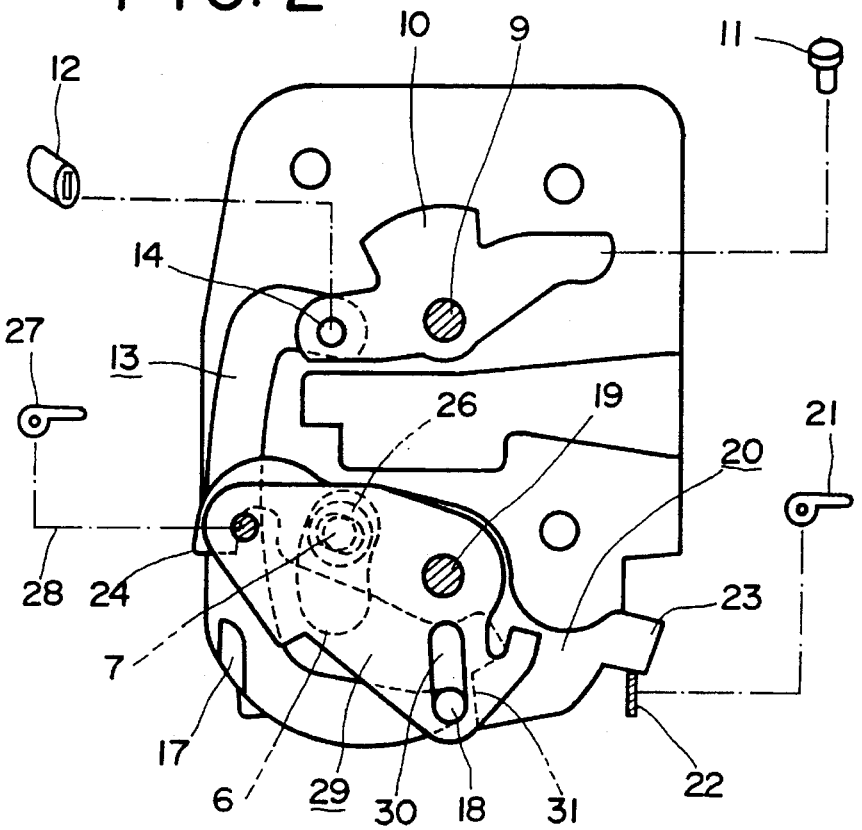

VEHICLE DOOR LOCK DEVICE

FIELD OF THE INVENTION

The present invention generally relates to a vehicle door lock device and more particularly to a one-motion opening mechanism and a self-canceling mechanism of a door lock device. Incidentally, a one-motion opening mechanism is defined herein as a mechanism through which a door can be opened by operating an inner opening handle mounted on the inside of a door even when the lock device is in a locked state. Moreover, a self-canceling mechanism is defined as a mechanism by which the state of the lock device is automatically changed into an unlocked state when a door is closed after the lock device is put into a locked state.

DESCRIPTION OF THE RELATED ART

Both of a one-motion opening mechanism and a self-canceling mechanism are typical options or parts having additional functions, with which a lock device is endowed, and have been proposed previously.

These kinds of mechanisms may be used in a lock device singly or in combination. Thus automakers select and employ the most appropriate one of three types of variations of a lock device.

A lock-device maker designs a lock device of the types which the automaker desires, according to the environment thereof, such as the structure and size of a door of an automobile, to which the lock device is mounted. However, if the design of the lock device has been once accomplished, it becomes difficult to replace a kind of a mechanism already mounted in the lock device with the other kind of a mechanism and to add the latter mechanism to the lock device. Even if such alterations are necessary, the details of the lock device should be redesigned. Alternatively, in order to save redesigning the lock device, an unnecessary part is kept secured to in the lock device.

SUMMARY OF THE INVENTION

Accordingly, an object of the present invention is to provide a lock device which can be freely selected from the three variations thereof by simply replacing a part thereof with another part.

To achieve the foregoing object, in accordance with the present invention, there is provided a lock device which comprises a first group lever consisting of three kinds of levers connected to a ratchet, and a second group lever consisting of two kinds of levers connected to an outer opening handle, wherein a lever of each of the group levers is selected according to a desired variation of the configuration of the lock device.

BRIEF DESCRIPTION OF THE DRAWINGS

Other features, objects and advantages of the present invention will become apparent from the following description of preferred embodiments with reference to the drawings in which like reference characters designate like or corresponding parts throughout several views, and in which:

FIG. 1 is a front view of a lock device;

FIG. 2 is a rear view of the lock device which is in an unlocked state;

DETAILED DESCRIPTION OF THE PREFERRED EMBODIMENTS

Figure 3:
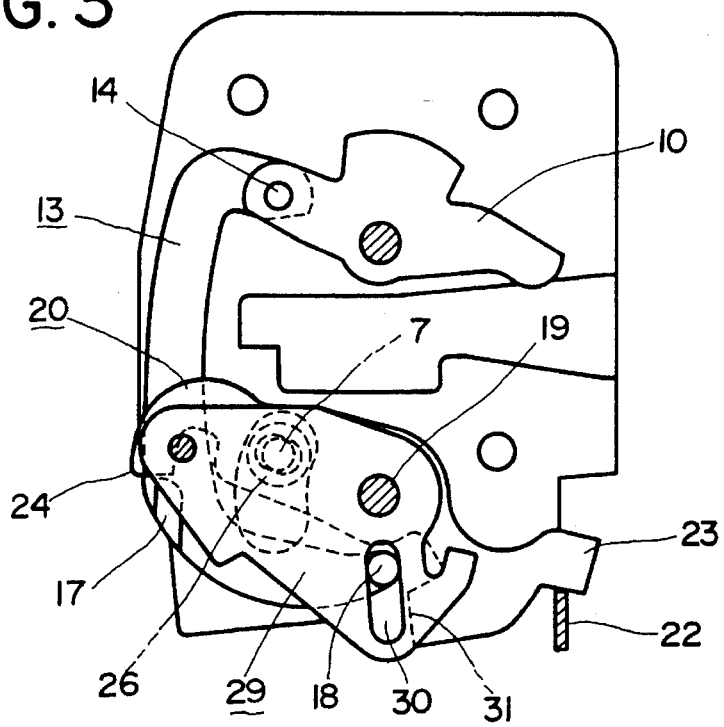
FIG. 3 is a rear view of the lock device which is in a locked state.
Figure 4:
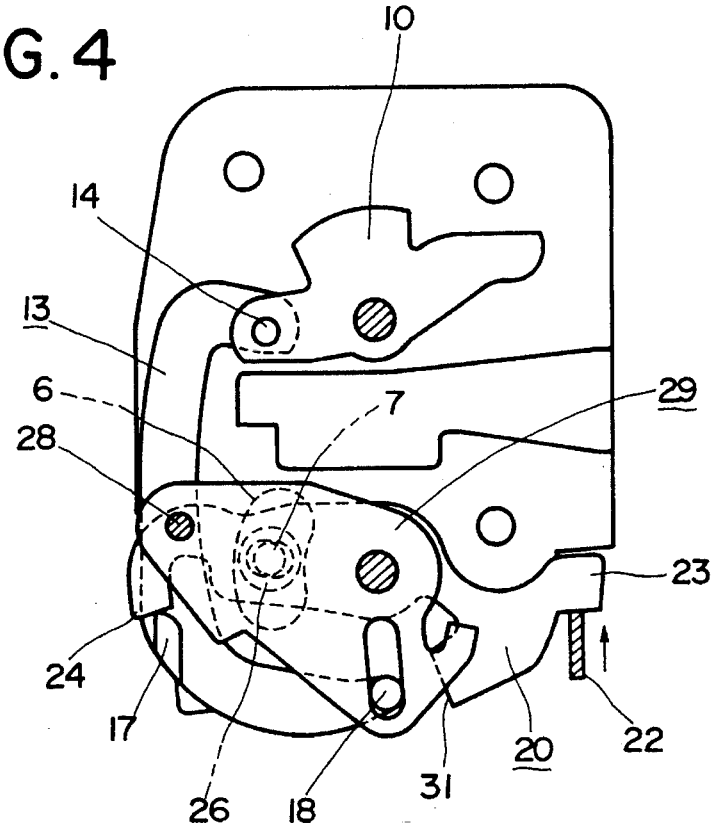
FIG. 4 is a diagram for illustrating operations of a one-motion opening mechanism and a self-canceling mechanism.

Hereinafter, the preferred embodiments of the present invention will be described in detail by referring to the accompanying drawings.

First, a lock device (hereunder referred to as a basic lock device), which is provided with both of a one-motion opening mechanism and a self-canceling mechanism, will be described hereinbelow by referring to FIGS. 1 to 8. A lock body 1 of the basic lock device has a concave or recess portion 2 in the front portion thereof. In the concave portion 2, a latch 4 engaging with a striker 3 secured to a vehicle body and a ratchet 5 engaging with the latch 4 are enclosed. On the ratchet 5, a pin 7 protruding therefrom to the rear of the lock device through a through hole 6 formed in the body 1 is provided. When the ratchet 5 moves in the direction of an arrow X against the resilience of a spring 8, the ratchet 5 is disengaged from the latch 4. Consequently, a door is opened. As is well known, the concave portion 2 is closed or covered with a cover plate (not shown).

As shown in FIG. 2, a lock lever 10 is fixed to an upper position or a first space on the rear surface of the lock body 1 through a shaft 9. An inside lock button 11 and a door key cylinder 12 are attached to the lock lever 10. By operating these elements, the position of the lock lever 10 is changed between the unlocked position (of FIG. 2) and the locked position (of FIG. 3), as is well known.

Figure 5:
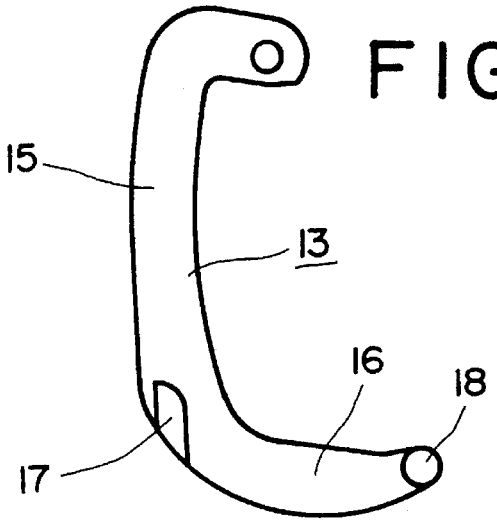
FIG. 5 is a plan view of an interlocking link.
Figure 6:
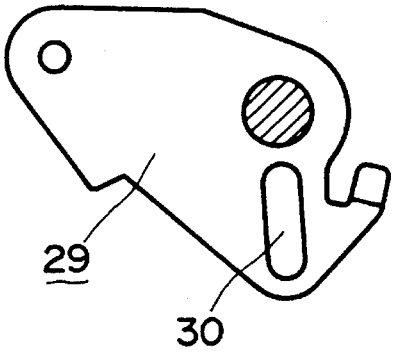
FIG. 6 is a plan view of an opening lever.

The top end of an interlocking lever 13 is fixed to the lock lever 10 by means of a pin 14. As illustrated in FIG. 5, the L-shaped link 13 is composed of a vertical portion 15, a horizontal portion 16, a convex portion 17 formed at a corner part thereof and a pin 18 formed at the tip of the horizontal portion 16.

Figure 7:
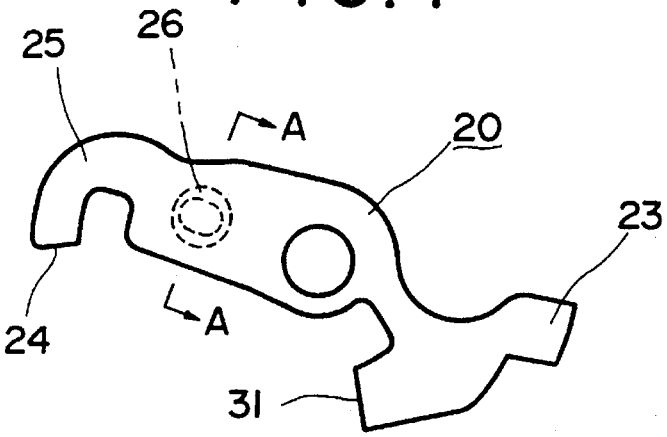
FIG. 7 is a plan view of a ratchet lever.
Figure 8:
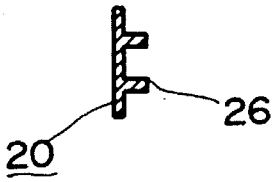
FIG. 8 is a sectional view taken on line A—A of FIG. 7.

A ratchet lever 20 is fixed to a lower position or a second space on the rear surface of the lock body 1 through a shaft 19. The ratchet lever 20 of the basic lock device is an important part for realizing a one-motion opening mechanism and a self-canceling mechanism. The plan view of the ratchet lever 20 is illustrated in FIG. 7. The ratchet lever 20 has a right arm 23, which can be put into abutting engagement with an inner lever 22 to be connected to an inner opening handle 21 of a door, and a left arm or releasing arm 25 provided with an end portion 24 which can be engaged with the convex portion 17 of the link 13. A cylindrical portion 26, into which the pin 7 of the ratchet 5 is inserted, is formed on the back surface of the left arm 25. As a result of engaging the pin 7 with the cylindrical portion 26, the ratchet 5 and the ratchet lever 20 rotates about the shaft 19 as one body. Thus, when the ratchet lever 20 rotates counterclockwise as a consequence of engaging the ratchet lever 20 with the inner lever 22, the ratchet 5 rotates in the direction of the arrow X against the resilience of the spring 8. Consequently, the door is opened.

The end portion 24 of the ratchet lever 20 faces the convex portion 17 of the link 13 when being in the locked state of FIG. 3. The anticlockwise rotation of the ratchet lever 20 results in the end portion 24 being engaged with the convex portion 17. Consequently, the position of the lock lever 10 is changed into the unlocked position (see FIG. 4) through the link 13. Thus, if the inner lever 22 is turned when being in the locked state, an operation of changing the state of the lock lever into the unlocked state and an operation of opening the door can be achieved simultaneously (namely, the one-motion opening mechanism can be realized).

An opening lever 29 connected to an outer opening handle 27 of the door through a rod 28 is fixed to the shaft 19. The opening lever 29 has an elongated hole 30 with which the pin 18 of the link 13 engages. The pin 18 is located in a lower part of the elongated hole 30 and faces an engagement portion 31 of the ratchet lever 20 when being in the unlocked state of FIG. 2. Thus, in the case where the lock lever is in the unlocked state, the rotation of the opening lever 29 causes the pin to engage with the engagement portion 31 and also causes the ratchet lever 20 to rotate. Thereby, the ratchet 5 is disengaged from the latch 4. However, in the case where the lock lever is in the locked state of FIG. 3, the pin 18 is located in an upper part of the elongated hole 30. Thus the pin 18 is disengaged from the engagement portion 31. Therefore, when the lock lever is in the locked state, the rotation of the opening lever 29 does not cause the pin 18 to engage with the engagement portion 31. Consequently, the door is left closed.

In the case of the aforementioned basic lock device, the self-canceling mechanism is realized by engaging the pin 7 of the ratchet 5 with the cylindrical portion 26 of the ratchet lever 20. When the latch 4 is engaged with the striker 3 by closing the door and is further rotated, the ratchet 5 is pushed by the peripheral portion 32 of the latch 4. Thus the ratchet 5 is moved in the direction of the arrow X against the resilience of the spring 8. Moreover, the ratchet lever 20 is turned counterclockwise, as viewed in FIG. 3. Therefore, even when the door is closed after the state of the lock device has been changed into the locked state, the link 13 is pushed down by the end portion 24 of the ratchet lever 20. As a result, the lock lever 10 is put back to the unlocked position thereof. When causing the self-canceling mechanism to stop functioning, the state of the lock device is first changed into a locked state and subsequently, the outer opening handle 27 is turned. Thereupon, the opening lever 29 rotates anticlockwise, as viewed in FIG. 3. Thus the link 13 swings around the pin 14, so that the projection 17 is disengaged from the end portion 24 of the ratchet lever 20. If the door is closed by maintaining this state, the end portion 24 of the ratchet lever 20 does not engage with the link 13. Consequently, the locked state is not canceled.

Figure 9:
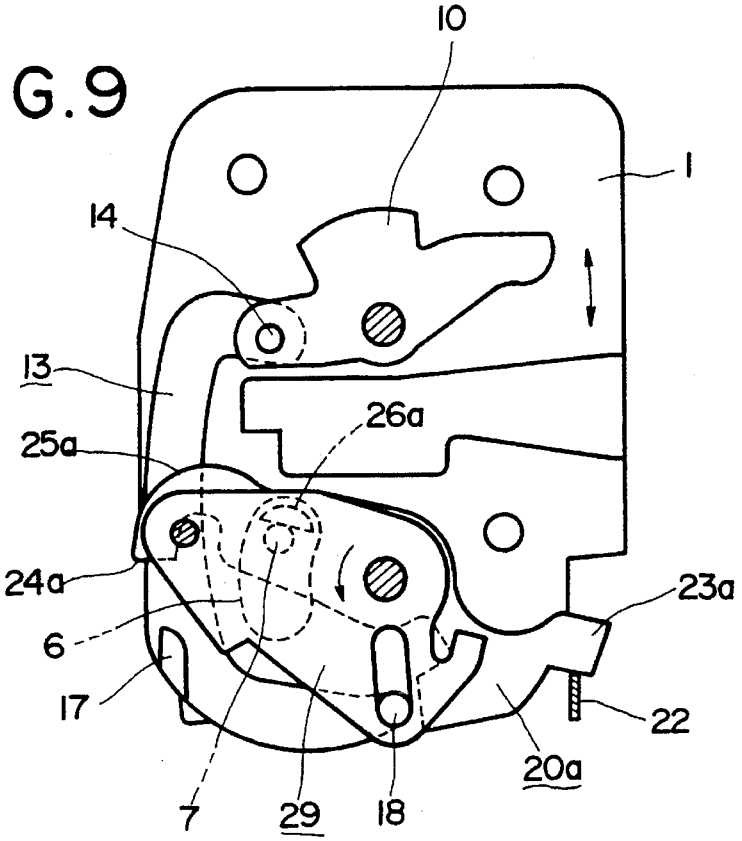
FIG. 9 is a rear view of a simplified lock device which is in an unlocked state.
Figure 10:
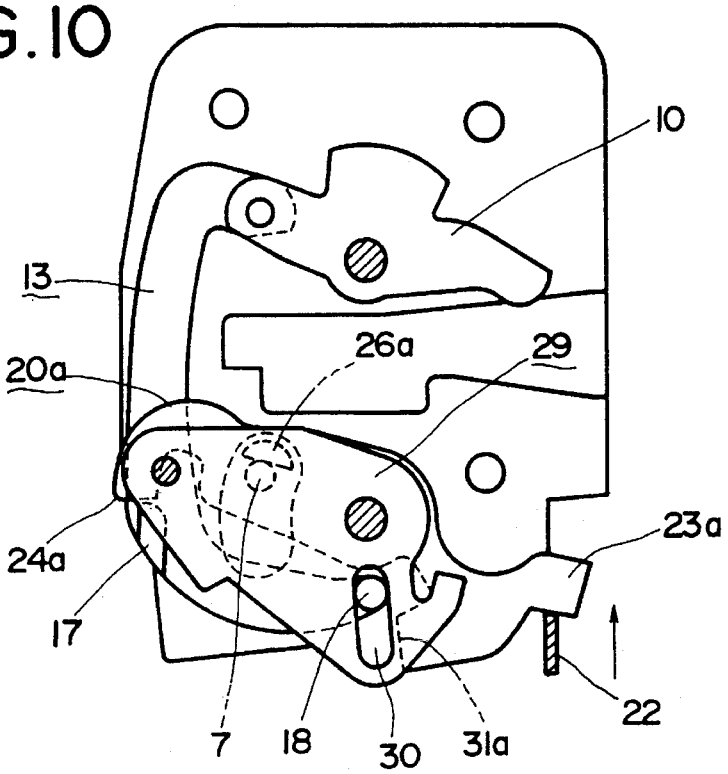
FIG. 10 is a rear view of the simplified lock device which is in a locked state.

Next, a simplified lock device obtained by removing the self-canceling mechanism from the aforementioned basic lock device will be described hereinafter with reference to FIGS. 9 to 14. The simplified lock device uses a ratchet lever **20*a* of FIG. 13 instead of the ratchet lever 20 of FIG. 7, though the remaining parts of the simplified lock device are entirely the same as the corresponding parts of the basic lock device, respectively. Outwardly, the ratchet lever 20*a* is the same as the ratchet lever 20 of FIG. 7. The ratchet lever 20*a*, however, has a projection-like member 26*a* in place of the cylindrical member 26 of the basic lock device. The member 26*a* is situated over the pin 7 of the ratchet 5 as illustrated in FIG. 9 so that the rotation of the ratchet lever 20*a* is transmitted to the ratchet 5 but a motion in the direction of the arrow X of the ratchet 5 is not transmitted to the ratchet lever 20*a* as is seen from FIG. 11. In the case where the one-way connection between the ratchet lever 20*a* and the ratchet 5 is established in this way, the ratchet lever 20*a* does not rotate even if the ratchet 5 moves in the direction of the arrow X when closing the door. Thus the link 13 does not move as is seen from FIG. 12**. Consequently, the locked state is not canceled.

Figure 11:
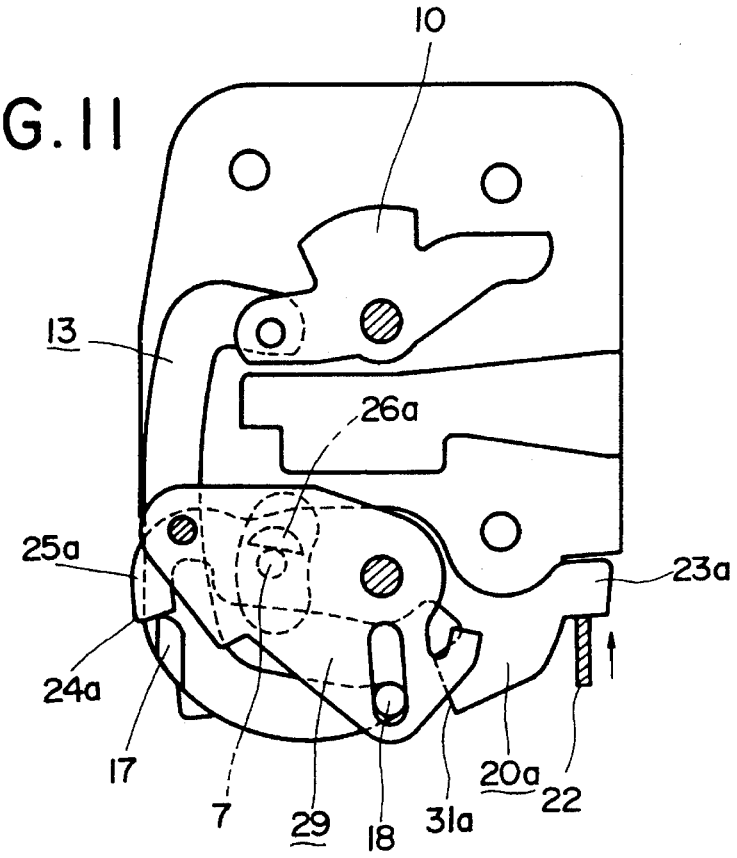
FIG. 11 is a diagram for illustrating an operation of a one-motion opening mechanism of the simplified lock device.
Figure 12:
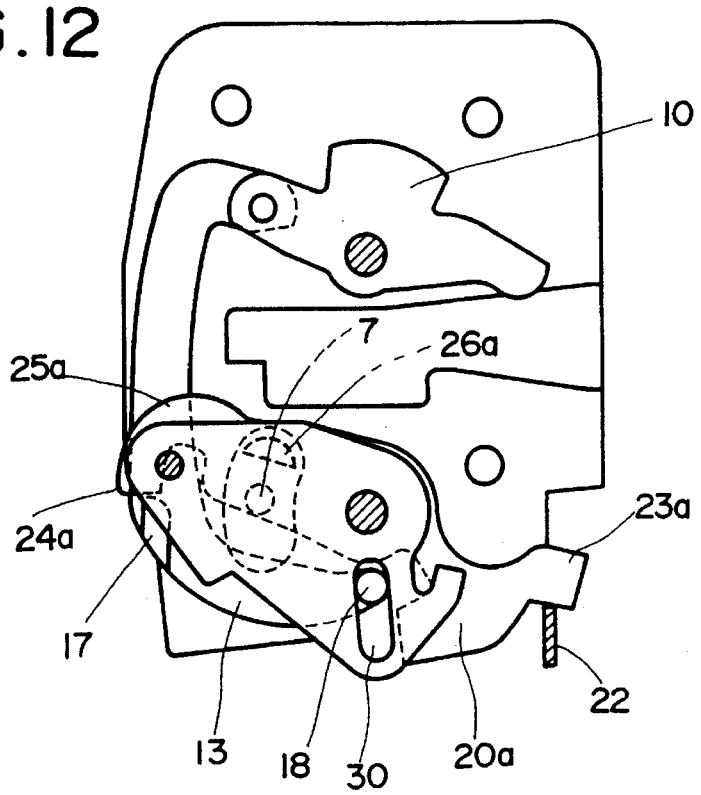
FIG. 12 is a diagram for illustrating the structure of the simplified lock device which is provided with no self-canceling mechanism.
Figure 13:
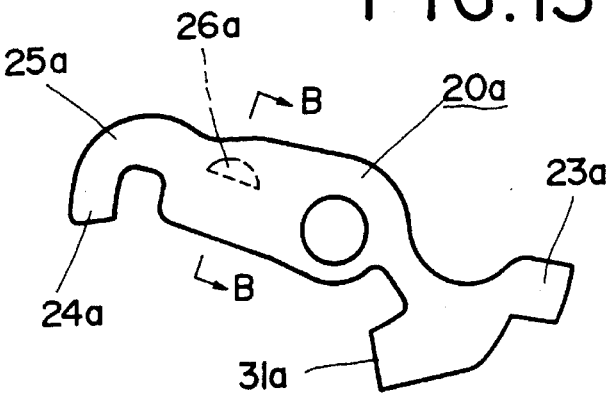
FIG. 13 is a plan view of a ratchet lever of the simplified lock device.
Figure 14:
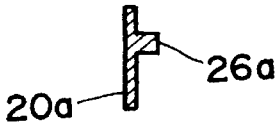
FIG. 14 is a sectional view taken on line B—B of FIG. 13.
Figure 19:
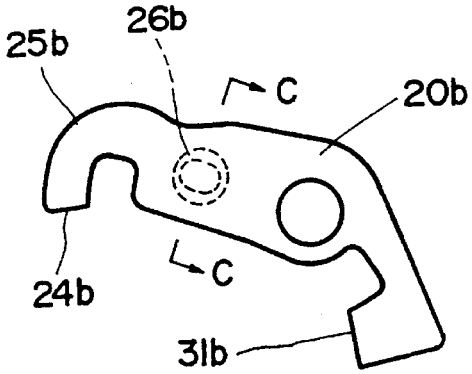
FIG. 19 is a plan view of a ratchet lever of the simplified lock device.
Figure 20:
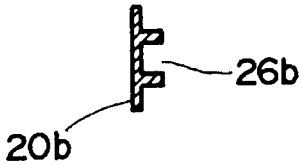
FIG. 20 is a sectional view taken on line C—C of FIG. 19.
Figure 18:
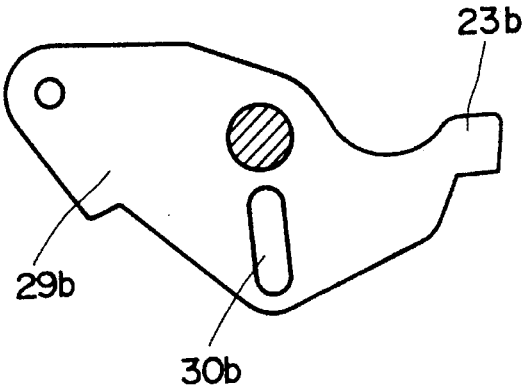
FIG. 18 is a plan view of an opening lever of this simplified lock device.
Figure 15:
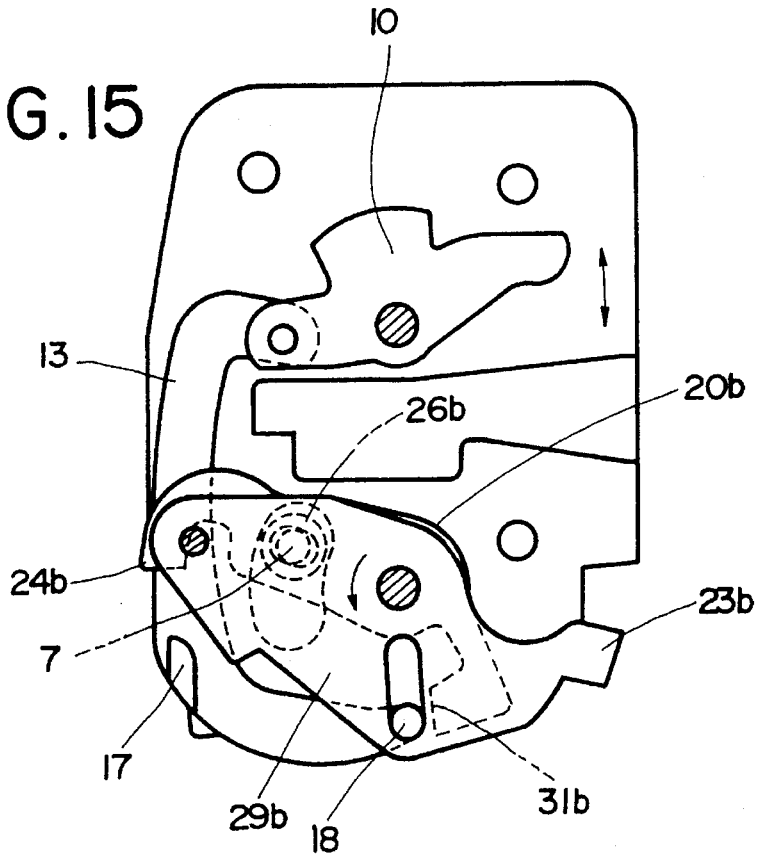
FIG. 15 is a rear view of another simplified lock device which is in an unlocked state.
Figure 16:
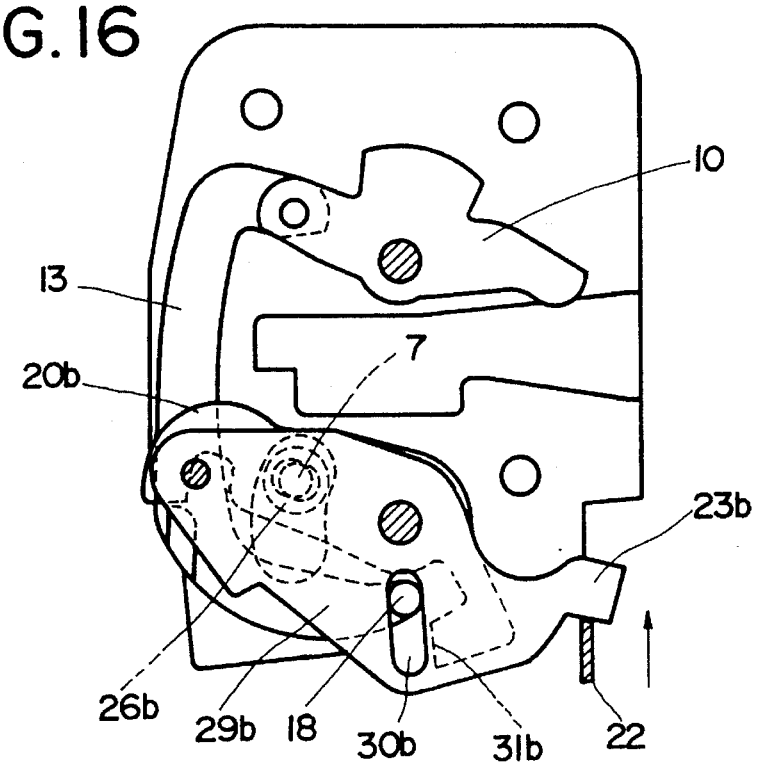
FIG. 16 is a rear view of this simplified lock device which is in a locked state.

The simplified lock device has an one-motion opening mechanism naturally. If the ratchet lever **20*a* is turned by operating the inner lever 22 when being in the locked state of FIG. 10, the member 26*a* engages with the pin 7 as shown in FIG. 11. Thus the ratchet 5 is disengaged from the latch 4. Simultaneously, the end portion 24*a* is brought into abutting engagement with the projection 17 of the link 13. Consequently, the lock lever 10** is put in the unlocked position.

Thus, the lock device, which does not have a self-canceling mechanism but have a one-motion opening mechanism, can be obtained.

Next, another simplified lock device, which is equipped with a self-canceling mechanism but with no one-motion opening mechanism, will be described hereinbelow by referring to FIGS. 15 to 20. Each of the parts of this simplified lock device, which are other than a ratchet lever **20*b* and an opening lever 29*b*, is completely the same as the corresponding part of the basic lock device. A right arm being capable of engaging with the inner lever 22 is formed in an opening lever 29*b* instead of the ratchet lever 20*b* and is designated by reference character 23*b*. As a result of this alteration, the inner lever 22 comes to be able to rotate the ratchet lever 20*b* through the opening lever 29*b* only when being in the unlocked state. In other words, the door can not be opened by operating the inner lever 22** when being in the locked state. Therefore, in the case of this simplified lock device, a one-motion opening mechanism can not be realized.

Figure 17:
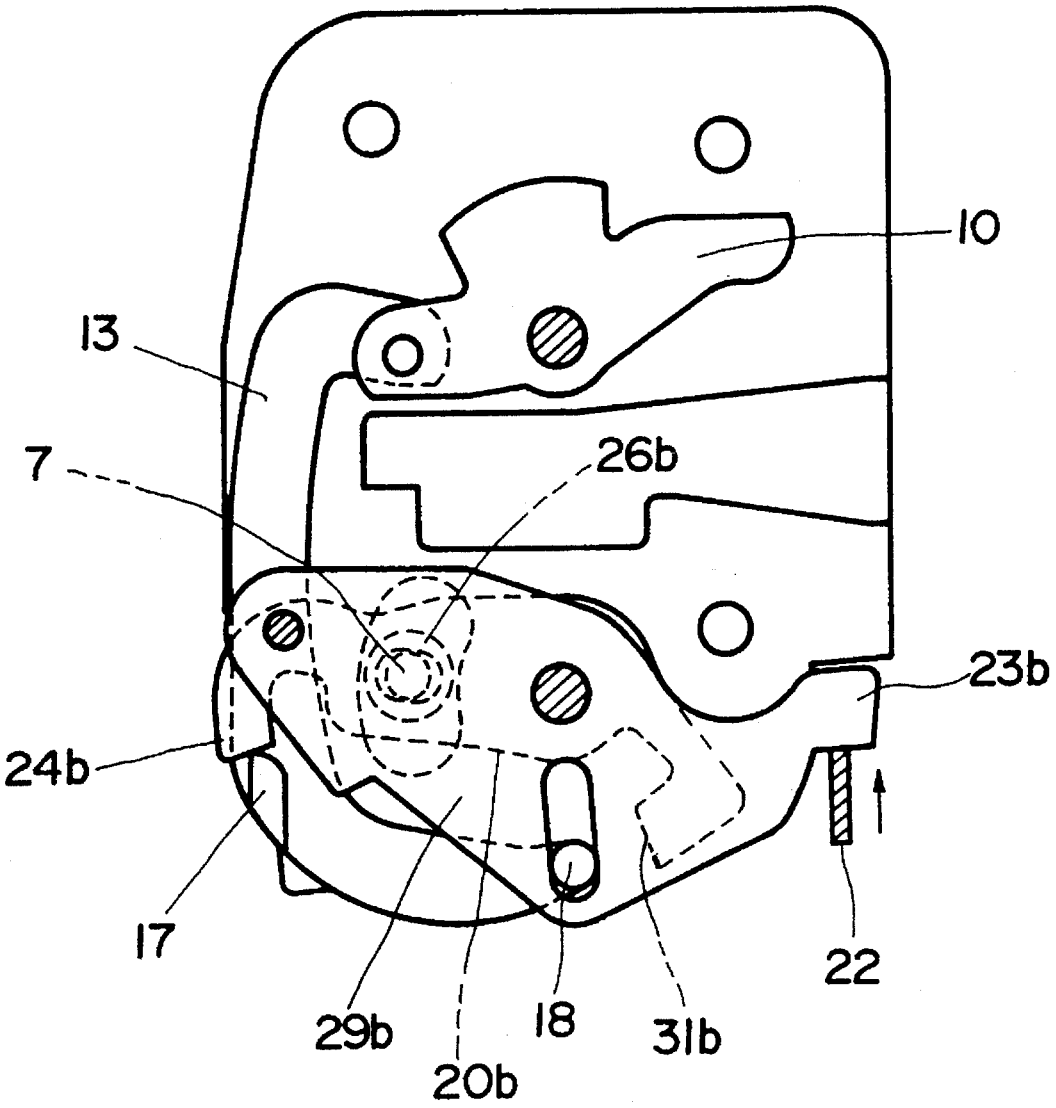
FIG. 17 is a diagram for illustrating an operation of a self-canceling mechanism of this simplified lock device.

The ratchet lever **20*b* has a cylindrical member 26*b*, into which the pin 7 of the ratchet 5 is inserted, similarly as in the case of the basic lock device. Thus, when the ratchet 5 is moved in the direction of the arrow X against the resilience of the spring 8 by closing the door, the ratchet lever 20*b* is turned counterclockwise as illustrated in FIG. 17. Further, an end portion 24***b* of the ratchet lever 20*b* pushes down the link 13, so that the position of the lock lever 10 is changed into an unlocked position (namely, the self-canceling mechanism is realized).

Thus, in accordance with the present invention, the configuration of a lock device can be freely selected from the three variations thereof by performing a simple replacement of parts thereof.

Although the preferred embodiments of the present invention have been described above, it should be understood that the present invention is not limited thereto and that other modifications will be apparent to those skilled in the art without departing from the spirit of the invention.

The scope of the present invention, therefore, is to be determined solely by the appended claims.

What is claimed is:

1. A vehicle door lock device comprising:

a latch engageable with a striker fixed to a vehicle body;

a ratchet for maintaining engagement of the latch with the striker in engagement with the latch;

a lock body having a concave portion, which encloses the latch and the ratchet, in a front part thereof and also having first and second spaces in a rear part thereof;

a ratchet lever for rotating the ratchet;

an opening lever which is connected to an outer opening handle of a door and is provided in such a manner to have a same axis of rotation as of the ratchet lever and to overlap the ratchet lever, said opening lever having an elongated hole;

said opening lever and said ratchet lever being provided in one of the first and second spaces;

a lock lever which is connected to a door key cylinder and a lock button and is adapted to change a position thereof between a locked position and an unlocked position, said lock lever being provided in the other of the first and second spaces;

an interlocking link having an end rotatably connected to the lock lever and also having another end in which a pin engaging with the elongated hole is provided, said pin being able to engage with the ratchet lever and causing the ratchet through the ratchet lever to turn by the operation of the opening lever when the lock lever is in the unlocked position, said pin being disengaged from the ratchet lever and becoming unable to engage with the ratchet lever when the lock lever is in the locked position;

said ratchet lever having a lock releasing arm adapted to engage with the interlocking link when the ratchet lever turns, and to change the position of the lock lever from the locked position to the unlocked position;

and being characterized in that the ratchet lever consists of any one of:

(A) a first ratchet lever which is connected to the ratchet in such a manner to be integral with the ratchet and is formed in such a manner to be integral with an inner arm engaging with an inner opening handle of the door;

(B) a second ratchet lever which is connected to the ratchet in such a manner to be integral with the ratchet and does not have the inner arm; and (C) a third ratchet lever which is connected to the ratchet in a one-way connection manner and has the inner arm;

in that the opening lever consists of any one of:

(a) a first opening lever which does not have the inner arm; and (b) a second opening lever formed in such a manner to be integral with the inner arm, whereby the lock device has a configuration which is selected from:

(1) a first variation having a combination of a first ratchet lever and a first opening lever, by which a one-motion opening mechanism and a self-canceling mechanism can be realized;

(2) a second variation having a combination of a third ratchet lever and a first opening lever, by which a one-motion opening mechanism can be realized but a self-canceling mechanism is removed from the lock device; and (3) a third variation having a combination of a second ratchet lever and a second opening lever, by which a self-canceling mechanism can be realized but a one-motion opening mechanism is removed from the lock device.

* * * * *